US011498117B1

(12) United States Patent
Maughan et al.

(10) Patent No.: US 11,498,117 B1
(45) Date of Patent: Nov. 15, 2022

(54) METHOD AND APPARATUS FOR SUPPORTING WAX PATTERN DURING INVESTMENT CASTING

(71) Applicant: GENERAL ELECTRIC COMPANY, Schenectady, NY (US)

(72) Inventors: James Rollins Maughan, Burnt Hills, NY (US); Jason Herzlinger, Schenectady, NY (US); Patrick Daniel Willson, Clifton Park, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/525,200

(22) Filed: Nov. 12, 2021

(51) Int. Cl.

| | |
|---|---|
| ***B22C 7/02*** | (2006.01) |
| ***B22C 9/04*** | (2006.01) |
| ***B22C 21/14*** | (2006.01) |
| ***B22C 9/24*** | (2006.01) |

(52) U.S. Cl.
CPC ..... *B22C 7/02* (2013.01); *B22C 9/043* (2013.01); *B22C 9/24* (2013.01); *B22C 21/14* (2013.01)

(58) Field of Classification Search
CPC .. B22C 7/02; B22C 9/043; B22C 9/24; B22C 21/14; B22C 9/04
See application file for complete search history.

(56) References Cited

U.S. PATENT DOCUMENTS 4,044,815 A 8/1977 Smashey et al.
4,062,396 A * 12/1977 Day ..... B22C 7/02 164/45
7,866,371 B2 * 1/2011 Hasselberg ..... B22C 21/14 164/412

* cited by examiner

*Primary Examiner* — Kevin P Kerns
*Assistant Examiner* — Steven S Ha
(74) *Attorney, Agent, or Firm* — Grogan, Tuccillo & Vanderleeden, LLP

(57) ABSTRACT

An approach for supporting a wax pattern during investment casting. The approach described herein forms a support structure to support the wax pattern during investment casting. The support structure has a capping structure with a geometry that can match a profile of a lower region of the wax pattern, and at least one support brace extending outward from the support capping structure. The support structure can be placed on a surface of the lower region. The support capping structure can form a defined envelope to enclose the lower region of the wax pattern. The support structure is connected to a base plate by the support brace(s). The capping structure and the support brace(s) secure the wax pattern to the base plate and distribute the load of the wax pattern to maximize strength while minimizing the risk of a discontinuity in the wax or shell that could affect the casting process.

11 Claims, 6 Drawing Sheets

METHOD AND APPARATUS FOR SUPPORTING WAX PATTERN DURING INVESTMENT CASTING

BACKGROUND

Technical Field

Embodiments of this disclosure relate generally to investment casting, and more specifically, to providing a support structure for supporting a wax pattern during investment casting of a part such as for example, a gas turbine part.

Discussion of Art

Investment casting is a commonly used technique for forming metallic components having complex geometries. The manufacture of gas turbine components or parts, such as turbine blades and nozzles, requires that the parts be manufactured with accurate dimensions having tight tolerances, making investment casting suitable for manufacturing these parts. In general, investment casting involves preparing a ceramic mold for creating a part or product design. Preparing the ceramic mold involves the use of one or more wax patterns of the part. The wax patterns are formed by molding wax into a shape generally corresponding to a positive of the part. If the part is intended to have interior passages, the wax patterns are formed around an internal ceramic core with a shape generally corresponding to the interior passages. Using a shelling process, a ceramic shell is formed around one or more of such wax patterns. After formation of the ceramic shell, the wax may be removed by melting, leaving a ceramic mold of the part. The part is cast by filling the ceramic mold with molten metal. Upon cooling and solidifying of the metal, the ceramic shell may be mechanically and/or chemically removed from the molded part. The part can then be machined and/or processed in one or more steps to obtain the part specified in the product design. If the part is not properly supported during this process the parts fabricated will not meet the specified product design requirements.

During the shelling process the part is dipped into a ceramic slurry that can be agitated or stagnant, and coated with refractory sand to form a hard exterior shell around the patterns. Stress induced on the part during this process can break the wax component or cause a crack to form in the shell that may lead to a defect in the casting. Typically, the wax patterns are assembled with supports into structures or wax "trees," which are turned upside down, dipped in the ceramic slurry, and coated with the refractory sand in multiple iterations or cycles to form layers that create the ceramic shell.

If the wax patterns are not sufficiently supported, the patterns can break due to the loads created during the shelling process. In particular, after each layer is gathered around the wax patterns, more weight is applied to the wax patterns, increasing the load on the patterns. However, after several layers are formed around the wax patterns, the ceramic shell that is shaping also becomes stronger and eventually becomes self-sustaining in terms of rigidity to form a structural component that can withstand the weight of the additional layers that are formed thereon.

Up until the point that the wax patterns have enough layers to withstand the weight of the additional layers that arise from the slurry and sand, the wax patterns are subject to breaking. A broken wax pattern can result in the loss of the pattern, an improperly shaped ceramic shell, and or a discontinuity in the shell that could affect the casting process and therefore, cast part. In addition, and particularly for the case of directionally solidified or single crystal castings where a specific grain structure and metallurgy are required, the support structures attached to the wax pattern can themselves affect the casting and solidification process, and therefore, the shape and quality of the cast part. Consequently, a significant challenge in the art of investment casting is the design of support structures which are sufficiently strong to maintain the shape and integrity of the wax pattern and tree during the shelling process, but which minimize the impact on the solidification and casting process.

BRIEF DESCRIPTION

The following presents a simplified summary of the disclosed subject matter in order to provide a basic understanding of some aspects of the various embodiments described herein. This summary is not an extensive overview of the various embodiments. It is not intended to exclusively identify key features or essential features of the claimed subject matter set forth in the Claims, nor is it intended as an aid in determining the scope of the claimed subject matter. Its sole purpose is to present some concepts of the disclosure in a streamlined form as a prelude to the more detailed description that is presented later.

The various embodiments of the present invention are directed to providing a solution that addresses the breakage issues that can arise during the shelling process of wax patterns while assembled to a tree due to the loads applied to the wax patterns during the ceramic slurry dipping and refractory sand coating steps of the shelling process, and to do so in a manner that has minimum impact on the casting process. The solution provided by the various embodiments includes a support structure to support the wax patterns during investment casting. The support structure of the various embodiment provides a more robust connection of the wax patterns while assembled to the tree that can better withstand the dipping in the ceramic slurry and coating with the refractory sand while undergoing the shelling process. This minimizes disruption of the investment casting due to breakage of the wax patterns that can occur during the shelling process or due to the impact of support structures on the solidification process.

The support structure of the various embodiments includes a support structure that can be applied to any location about the wax pattern. The support structure of the various embodiments can uniformly distribute forces applied to the wax pattern from shelling to minimize risk of deformation or breakage, and also to minimize attachments and intrusion to the pattern which could affect the casting process.

In one embodiment, the support structure can include a support capping structure placed on a surface of a lower region of the wax pattern. The support capping structure has a geometry that matches a profile of the lower region of the wax pattern. To this extent, the support capping structure forms a defined envelope around the surface of the wax pattern after placement thereon, which uniformly distributes forces applied to the wax pattern from shelling to minimize risk of deformation or breakage, and also to minimize attachments and intrusion to the pattern which could affect the casting process. In one embodiment, the defined envelope can be formed around the bottom surface of the wax pattern and can extend upward to enclose a lower region of the wax pattern. The support structure of this embodiment can further include at least one support brace to support the support capping structure with respect to the lower region of the wax pattern. In one embodiment, the support structure can include a plurality of support braces extending outward from the support capping structure.

The support structure of the various embodiments can be formed with an additive manufacturing process. In one embodiment, the additive manufacturing process can include three-dimensional (3D) printing. To this extent, the components of the support structure such as the support capping structure and the support brace(s) can be additive printed. For example, the 3D printing additive manufacturing process can ensure that the support capping structure is formed to match the shape of the bottom surface of the wax pattern and/or the lower region of the wax pattern so that it can fit over these parts of the wax pattern. A 3D printing additive manufacturing process to generate the support structure is preferable because of its customizable ability to form a support structure with a desired profile. In addition, 3D printing additive manufacturing makes it easy to duplicate the printed design and use it across multiple part configurations. Nevertheless, other embodiments can use hard or temporary tooling to form the support structure described herein.

In one embodiment in which the support structure is the aforementioned support capping structure, 3D printing additive manufacturing can be used to precisely match the surface of the lower region of the wax pattern providing a conformal cap that distributes the load and provides attachment points that are not intrusive to the wax pattern.

After formation of the support capping structure, it can be placed on the surface of the lower region of the wax pattern to enclose this part of the wax pattern per the envelope. The support capping structure can be connected to a base plate used in the investment casting process to support the wax pattern and any other similar wax patterns assembled to a tree that connects to the base plate. In particular, the support brace(s) of the support structure of each wax pattern assembled with the tree are connected to the base plate. In one embodiment, in which a plurality of support braces are utilized, each of the braces can be angled to the support capping structure and the base plate. In addition, each of the plurality of support braces can be spaced apart from one another at the support capping structure and the base plate. For example, the spacing between each of the support braces at the base plate can be greater than the spacing of each of the support braces at the support capping structure. This allows the support braces to provide support in multiple directions.

While secured to the base plate, the support capping structure and the plurality of support braces can uniformly distribute the load of the wax pattern. With this configuration of the support structure and its coupling of the wax pattern and the base plate, the support capping structure will support a greater portion of the load of the wax pattern as compared to a portion of the load supported by the plurality of support braces. Furthermore, the force of the load of the wax pattern received by the support capping structure is distributed evenly against the bottom surface and/or the lower region of the wax pattern. Also, the angling of the support braces to the support capping structure and the base plate allows the support capping structure to provide more mechanical leverage in this supported configuration.

With the capability to uniformly distribute the load of the wax pattern such that the support capping structure supports a greater portion of the load and evenly distributes it against the bottom surface and/or lower region of the wax pattern, the solution offered by the various embodiments reduces the risk of breakage of the wax pattern during the shelling process of the pattern. Further, because the support structure, and in particular, the support capping structure, matches the geometry of the bottom surface and/or lower region of the wax pattern, the risk that the support structure will break during the shelling process is minimal. In particular, during the shelling process, the entire wax pattern, including the wax pattern and the support structure, will be covered in multiple layers of ceramic slurry before the wax is subsequently removed through melting in a dewaxing process. The consequential effect is that the inner surface of the casting transitions smoothly from the inside of the support capping structure to the inside of the shell with no discernible thermal or geometric impact on the casting that can lead to breakage, and thus, interruption of the investment casting of the part.

Furthermore, the configuration of this embodiment as well as the other various embodiments of the present invention can achieve uniform loading and improved support of the wax pattern without the direct attachment of wax supports to the wax pattern or invasive ceramic supports that extend into or through the wax pattern, which are common features associated with conventional approaches used to support a wax pattern during investment casting. Having wax supports that directly attach to the wax pattern or ceramic supports that extend into or through the wax pattern create nonuniformities with the support of the wax pattern. Each such nonuniformity is a risk that could degrade the grain structure of the wax pattern. The various embodiments obviate this risk by providing a support structure that not only supports the pattern, but does so without any components sticking into or out of the wax pattern.

In accordance with one embodiment, an apparatus to support a wax pattern of a part that is to be cast to a base plate during an investment casting process of the part is provided. The apparatus comprises: a support structure placed about the wax pattern, wherein the support structure matches a shape of a surface of the wax pattern; and at least one support brace extending outward from the support structure to connect to the base plate, wherein the support structure and the at least one support brace secure the wax pattern to the base plate in a fixed position and distribute the load of the wax pattern while secured to the base plate.

In accordance with another embodiment, a method for supporting a wax pattern of a part during an investment casting process of the part is provided. The method comprises: forming a support structure to support the wax pattern during the investment casting of the part, wherein the support structure comprises a support capping structure with a geometry that matches a profile of a lower region of the wax pattern, and a plurality of support braces extending outward from the support capping structure; placing the support structure on a surface of the lower region of the wax pattern, wherein the support capping structure forms a defined envelope around the lower region of the wax pattern after placement thereon; and connecting the support structure to a base plate, wherein the plurality of support braces connect to the base plate, wherein the support capping structure and the plurality of support braces secure the wax pattern to the base plate in a fixed position and uniformly distribute the load of the wax pattern while secured to the base plate.

In accordance with third embodiment, a method is provided. The method comprises: obtaining a wax pattern of a part; printing a support structure to support the wax pattern with an additive manufacturing process, wherein the support structure comprises a support capping structure with a geometry that matches a profile of a lower region of the wax pattern, and a plurality of support braces extending outward from the support capping structure; placing the support structure on a surface of the lower region of the wax pattern, wherein the support capping structure forms a defined envelope to enclose the lower region of the wax pattern after placement thereon; connecting the support structure to a base plate, wherein the plurality of support braces support connect to the base plate, wherein the capping structure and the plurality of support braces secure the wax pattern to the base plate and uniformly distribute the load of the wax pattern while secured to the base plate; and creating a mold shell that surrounds the wax pattern and the support structure while the wax pattern is secured to the base plate.

DRAWINGS

The present invention will be better understood from reading the following description of non-limiting embodiments, with reference to the attached drawings, wherein below:

Figure 2:
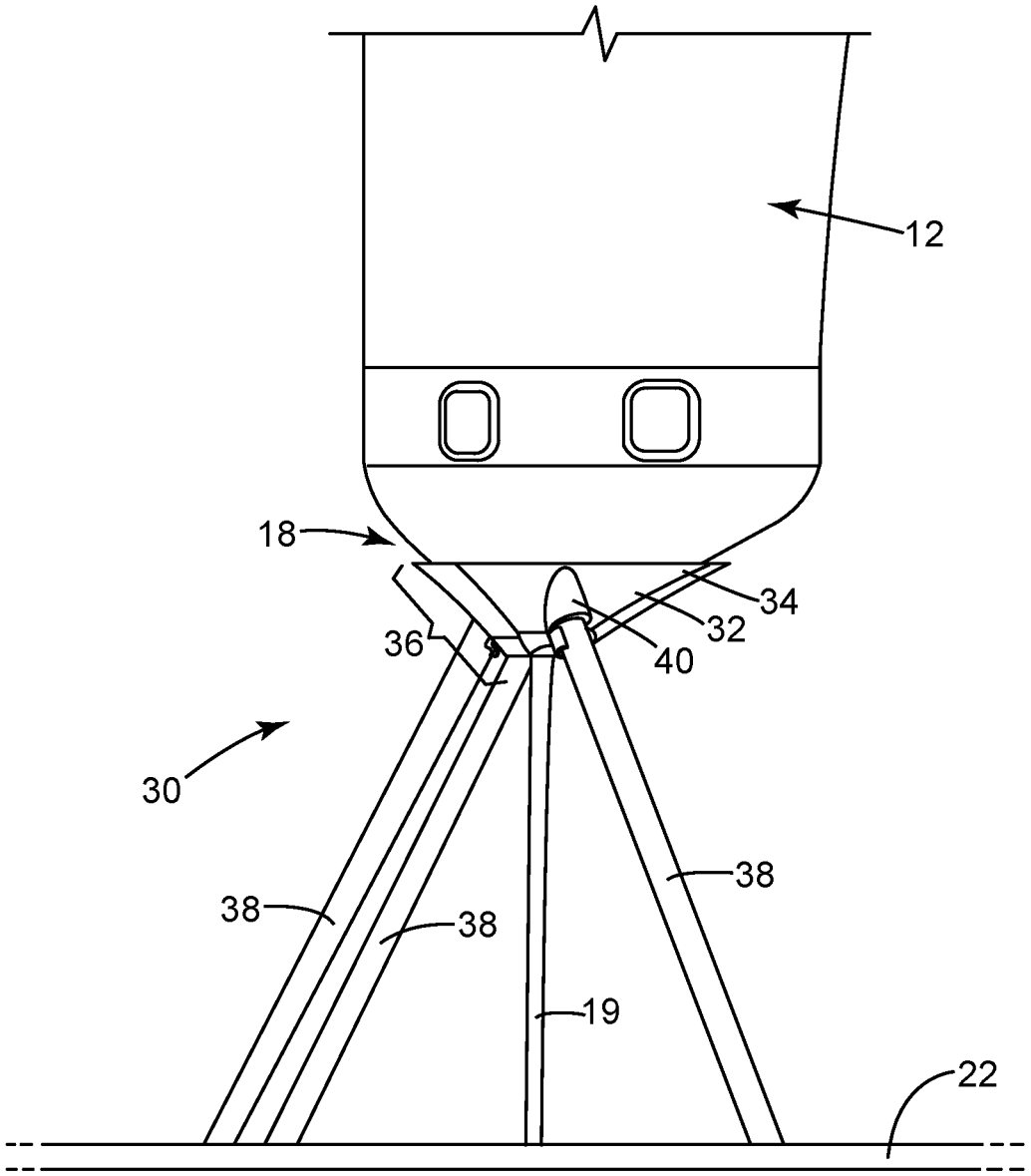
FIG. 2 shows a schematic of a side view of a support structure for supporting a wax pattern of a part that is to be cast in an investment casting process according to an embodiment of the invention.
Figure 5:
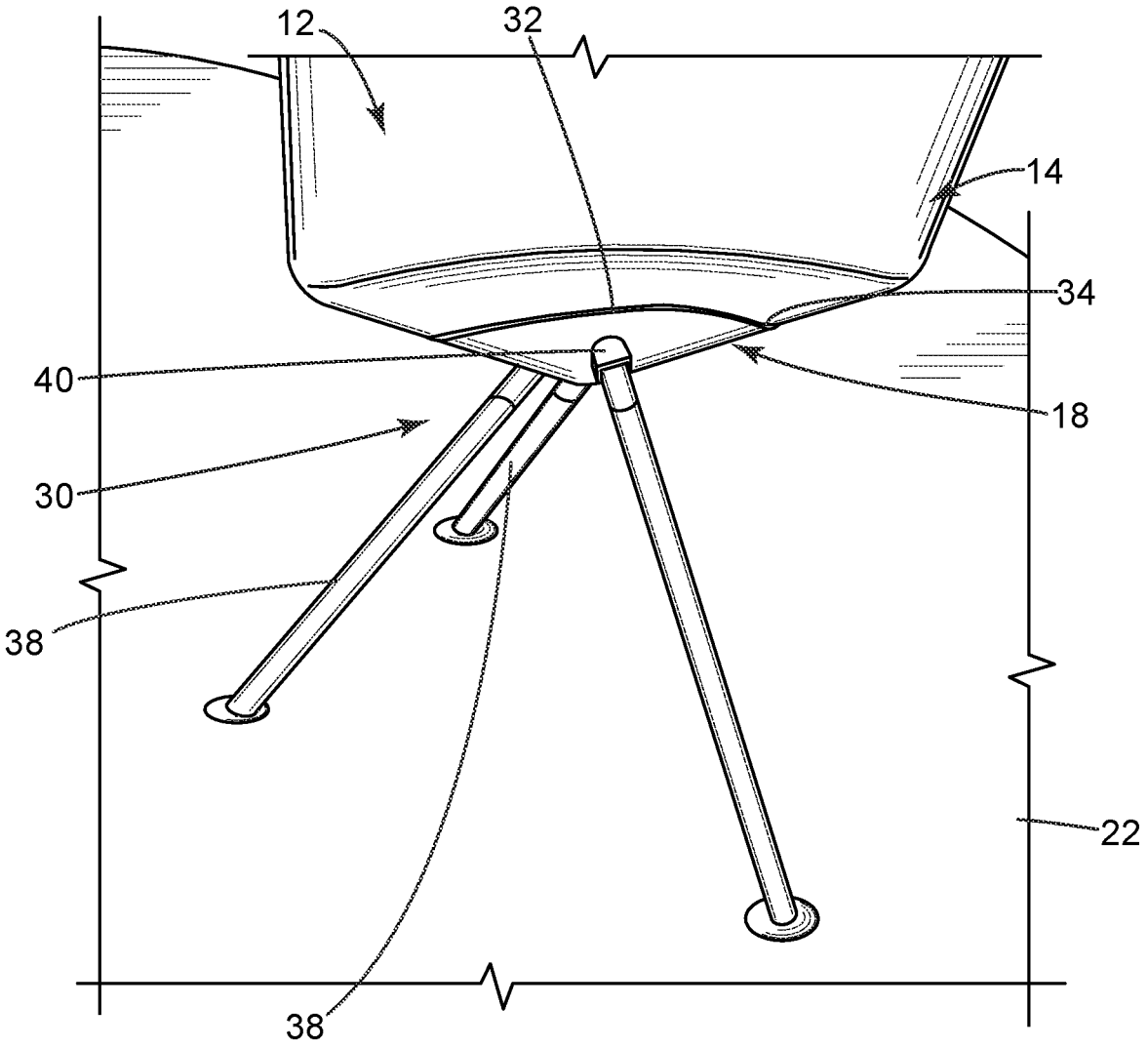
Figure 6:
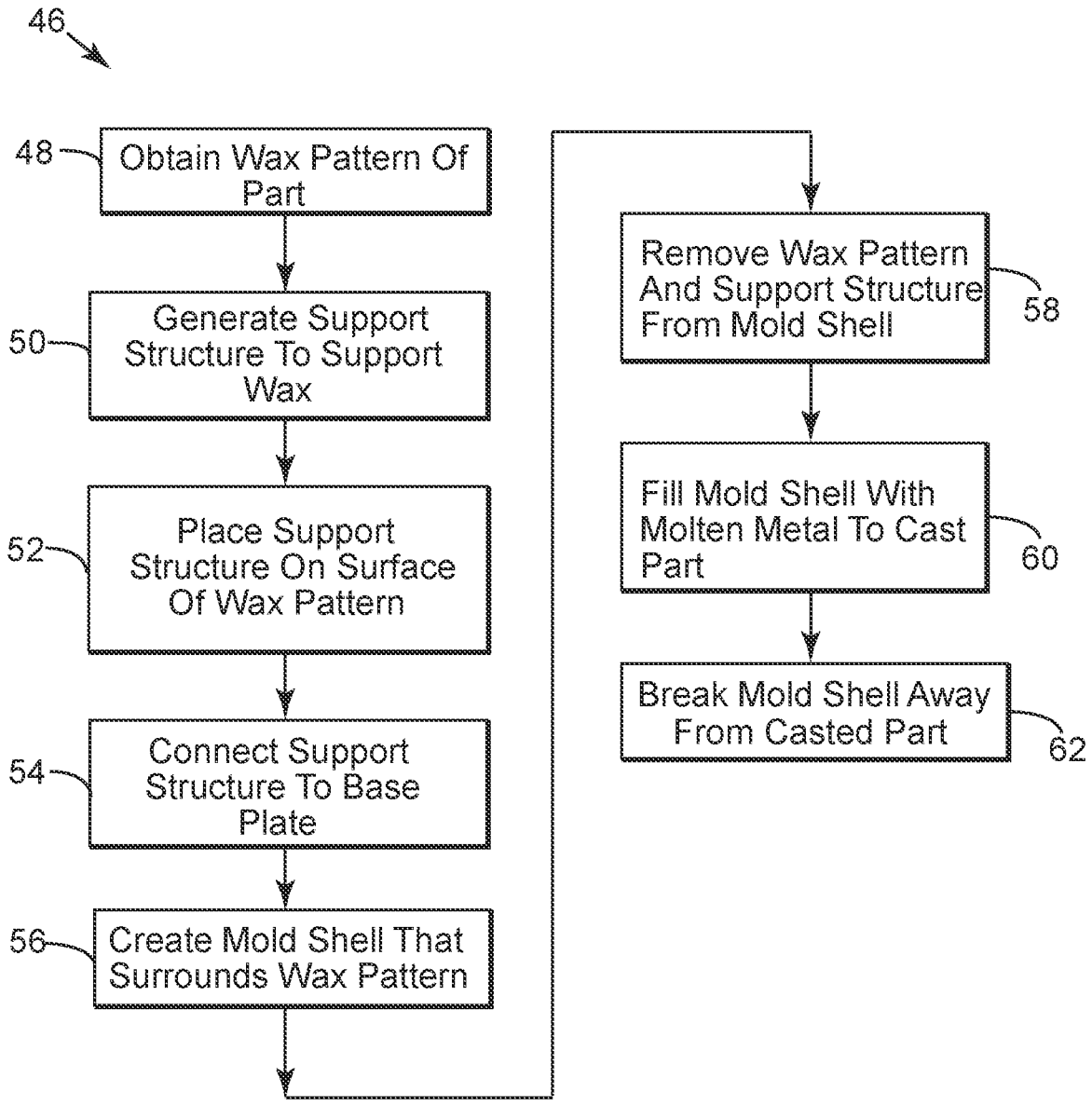

FIG. 5 shows a schematic of a more detailed view of the support capping structure and the support braces of the support structure depicted in FIG. 2 according to an embodiment of the invention; and FIG. 6 shows a flow chart illustrating the operations associated with the investment casting of a part from a wax pattern supported by a support structure depicted in FIGS. 2-5 according to an embodiment of the invention.

DETAILED DESCRIPTION

Example embodiments of the present invention will be described more fully hereinafter with reference to the accompanying drawings, in which some, but not all embodiments are shown. Indeed, the present invention may be embodied in many different forms and should not be construed as limited to the embodiments set forth herein; rather, these embodiments are provided so that this disclosure will satisfy applicable legal requirements. For like numbers may refer to like elements throughout.

As indicated above, this disclosure relates generally to investment casting, and more specifically, to providing a support structure for supporting a wax pattern during investment casting of a part. The description of the various embodiments that follows is directed to the casting of a turbine part such as a gas turbine part. Examples of gas turbine parts that can be investment casted with the use of a support structure described herein can include, but are not limited to, turbine blades and nozzles. It is understood that other parts or components in the hot gas path of a gas turbine system that are typically produced by investment casting are applicable for use with the support structure of the various embodiments. Furthermore, although the description of the various embodiments is described with respect to turbine parts, it is not meant to be limiting. The support structure and methods associated therewith are suitable for use with the investment casting of any part or component that can be prone to breakage during the shelling process of investment casting in which a wax pattern(s) of a part undergoes dipping in an agitated or stagnant ceramic slurry and coating with refractory sand to form a ceramic shell that encloses the wax pattern(s).

Figure 1:
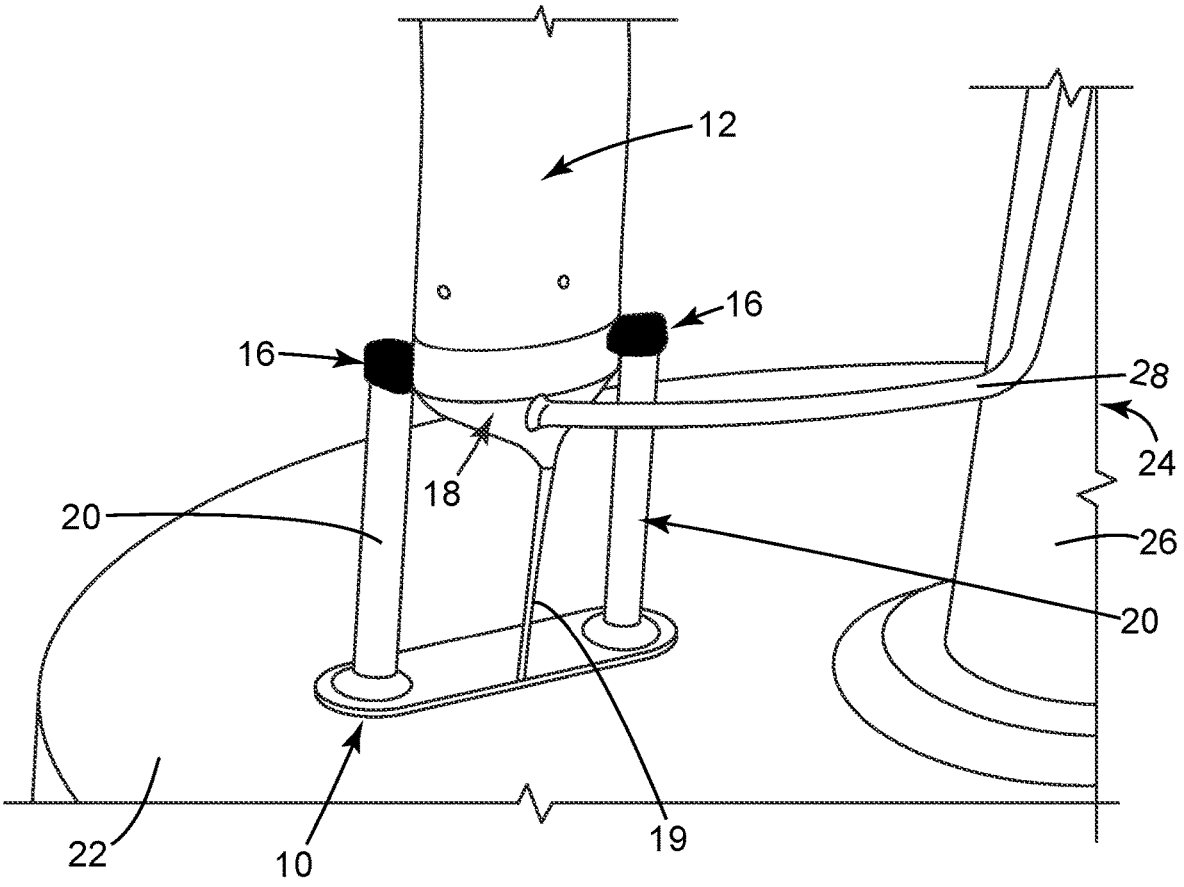
FIG. 1 Prior Art
FIG. 1 shows a schematic of a support structure for supporting a wax pattern of a part that is to be cast in an investment casting process according to the prior art.

Turning now to the figures, FIG. 1 shows a schematic of a support structure 10 for supporting a wax pattern of a part that is to be cast in an investment casting process according to the prior art. As mentioned above, during the shelling process of the investment casting of a part, the wax patterns are subject to breakage during the dipping in the ceramic slurry and coating with the refractory sand due to the loads applied to the wax patterns. The support structure 10 depicted in FIG. 1 shows one approach that has been used to support a wax pattern 12 of a gas turbine part (e.g., a blade wax pattern). The support structure 10 of FIG. 1 includes wax connector joints 16 secured to the wax pattern 12 at one or two locations about the lower region 18 of the wax pattern 12. FIG. 1 also includes for completeness a feed runner 28 through which molten alloy is supplied to the mold and a seed selector 19 which initiates crystal growth and the solidification process. As shown in FIG. 1, the wax connectors 16 are secured directly to the "the wax pattern 12.

The support structure 10 of FIG. 1 further includes connecting legs 20 extending vertically downward from each of the wax connector joints 16 to a base plate 22 that is used to secure a tree 24 having the feed runner 28 to deliver the metal or alloy to each of the wax patterns 12 assembled to the tree 24 in the metal casting of the investment casting process. As shown in FIG. 1, the feed runner 28 is operatively coupled to the tree 24 via a vertical member 26 of the tree that can allow for horizontal bracing to be applied such as with the feed runner. The connecting legs 20 can include standardized rods that hold up the wax pattern 12 with respect to the base plate 22. Although the tree 24 depicted in FIG. 1 only shows one wax pattern 12, the tree can include more wax patterns spaced apart from each other. For example, the tree 24 can have three or more wax patterns 12 of the gas turbine part, with each of these patterns separated by predetermined spacing. In addition, it is understood that each of these wax patterns 12 would have a support structure 10 that secures and supports the wax patterns on the tree 24 to the base plate 22.

In the shelling process, the tree 24 is turned upside down and dipped into a ceramic slurry and coated with refractory sand in a multiple of iterations to form a hard exterior shell around the wax patterns 12 that includes a multiple of layers. The assembly of the tree 24 with one or more wax patterns 12 secured to the base plate 22 can be heavy enough that the patterns can break during the dipping in the ceramic slurry and coating with the refractory sand due to the loads applied to the wax patterns. In particular, in this configuration, the wax connector joints 16 are one area where the breakage can occur. This breakage at the "hips" of the wax pattern 12 can be frequent. As a result, the failure of the support structure 10 to support the wax pattern can be disruptive to the investment casting process of the part formed from the wax patterns. Not only are the wax connector joints 16 a fragile part of the design of the support structure 10, but the connecting legs 20 of the support structure provide only a limited amount support for loads that are normal to the surface of the wax pattern 12 during the shelling process. Consequently, stresses arise on the wax connector and frequently cause cracking and failure that ultimately leads to the breakage of the pattern during the shelling process. In addition, due to the location and design of the wax connector joints 16, a discontinuous wax surface can take form at the joints which can lead to poor casting grain structure.

The support structure and method of generating the support structure of the various embodiments overcome the weakness of the support structure 10 depicted in FIG. 1 by providing a more robust connection, which equates to minimal disruption to the investment casting process. In one embodiment, the support structure includes a support capping structure which has a thin walled shell of ceramic formed to match the shape of the lower region of the wax pattern representative of the part to be cast. In the various embodiments of the present invention, having the support structure match the shape of a region of the wax pattern means that the support structure has a shape that is approximately the same geometric surface profile as the region of the wax pattern that is most adjacent to the support structure. In the case of a turbine blade, the support capping structure, in one embodiment, can be fitted over the tip of the blade. Fitting over the tip in this manner, enables the support capping structure to provide uniform and distributed support to the wax pattern without creating a discontinuity in the wax surface. The support capping structure is braced to the underlying base plate with at least one support brace that can include ceramic posts. To this extent, the support structure of the various embodiments can hold the fragile wax pattern with a more uniformly distributed load and stronger materials due to the ceramic capping structure enclosing the tip, while the support brace(s), secured to the base plate, can provide support in multiple directions. Further, an additive manufacturing process such as three-dimensional (3D) printing ensures that the support capping structure is printed to match the shape of the blade (i.e., the part embodied by the wax pattern). As a result, there is a reduced risk of the capping structure or the supports brace(s) breaking.

FIGS. 2-5 show various views of a support structure 30 for supporting the wax pattern 12 of the turbine part according to an embodiment of the invention. As shown in these figures, the support structure 30 can include a support capping structure 32 placed on a bottom surface 34 about the lower region 18 of the wax pattern 12. The support capping structure 32 can have a shape that matches the bottom surface 34 of the wax pattern 12. In particular, the support capping structure 32 can have a geometry that matches a profile of the lower region 18 of the wax pattern 12. For example, the geometry of the support capping structure 32 matches the profile of the tip of the turbine blade. In this manner, the support capping structure 32 can be placed over the bottom surface 34 of the wax pattern 12 at the lower region 18 of the wax pattern. To this extent, the support capping structure 32 forms a defined envelope (i.e., an enclosing structure) 36 around the bottom surface 34 of the wax pattern 12. As shown in FIG. 2, the defined envelope 36 formed around the bottom surface 34 of the wax pattern 12 extends upward to enclose the lower region 18 of the wax pattern.

To this extent, the support capping structure 32, when placed over the bottom surface 34 of the wax pattern 12 around the lower region 18 of the tip, can provide uniform and distributed support of this tip region of the turbine part. That is, the support capping structure 32 can receive the force of the load of the wax pattern 12 and distribute it evenly against the bottom surface 34 of the wax pattern 12 at the lower region 18. This is advantageous for loads that are normal to the wax pattern 12 because the support structure of these embodiments can fully support normal loads and not provide only limited support like the structure of FIG. 1. As a result, the support capping structure 32 can support a much greater load because the force is evenly distributed against the tip surface of the wax pattern 12 with a continuous ceramic interface.

In one embodiment, the support capping structure 32 can be formed from an additive manufacturing process. For example, 3D printing can be used to print the support capping structure 32 with ceramic material that has a geometry that matches that profile of the lower region 18 of the wax pattern 12 (e.g., the tip). In one scenario, a ceramic tip cap can be printed in a, layer wise fashion, using a lithographic method, described in U.S. Pat. No. 10,967,564 B2, by using ceramic slurry composed of a material suitable for investment casting temperatures and environmental conditions including, but not limited to Alumina, Silica, Zirconia, and Yittria matching the thermal expansion of the shelling material. This can also be extended to other 3D printing modalities including, but not limited to, Binder Jet and Fused Deposition Modeling.

It is preferable to print the support capping structure 32 with a ceramic because of its strength and suitability to operate in a high temperature settings. Examples of ceramic material suitable for printing the support capping structure 32 can include, but are not limited to, Alumina, Silica, Zirconia, Yittria and or combinations of these constituents matching the thermal expansion of the shelling material. Although it is preferable to use ceramic material to print the support capping structure 32, the use of other materials may be possible.

The use of 3D printing to generate the support structure 30 including the support capping structure 32 is not meant to be limiting. Other additive manufacturing processes can be used to generate the support structure 30 including the support capping structure 32. These other additive manufacturing processes can include, but are not limited to, powder bed fusion, direct metal laser melting, electron beam melting, and binder jetting.

It is understood that the support structure 30 including the support capping structure 32 can be generated using other approaches. In one embodiment, hard or temporary tooling can be used to form the support structure 30. For example, the capping structure 32 can itself be cast or formed from an injection molded ceramic. This can be advantageous in scenarios where there is a need to generate a large volume of prototypes.

It is understood that the support capping structure 32 depicted in FIGS. 2-5, is not meant to be limiting to the embodiments described herein. The support capping structure 32 of these figures illustrates only one possibility of supporting the tip region of the turbine part in a way that can uniformly distribute the load of the wax pattern 12 against the lower region 18. Those skilled in the art will appreciate that a support structure can be extended up further along the lower region 18 of the wax pattern 12 to provide an additional amount of support. In other embodiments, the support structure can be shaped differently than the cup-like geometry depicted in FIGS. 2-5. For example, the support structure can take the form of a ring that encircles the lower region 18 of the wax pattern 12. In this manner, the ring can encircle the lower region 18 with the bottom surface 34 not covered by the ring. In another embodiment, the support structure can have forked-shaped structures to support the lower region 18 of the wax pattern 12. In essence, the support structure of the various embodiments can be applied to any location about the wax pattern. In one example in which the turbine part is a turbine blade, the support structure can be placed at a region around the platform of the blade. In another example, a support structure can be created that connects the wax pattern 12 to the down pole (i.e., the vertical member 26) of the tree 24 giving the pattern cross bracing.

Moreover, for embodiments in which the wax pattern takes on the shape of a different part, including other gas turbine parts, as well as any other part or component outside of the gas turbine realm, it is understood that the shape and placement of a support structure used to provide uniform and distributed support will depend on the profile and shape that is associated with the pertinent part or component.

Referring back to FIGS. 2-5, the support structure 30 can include at least one support brace to support the support capping structure 32 with respect to the lower region of the wax pattern 12. In one embodiment, as shown in FIGS. 2-5, the support structure 30 can further include a plurality of support braces 38 extending outward from the support capping structure 32, about a grain starter hole 39 (FIG. 3) where the grain starter is connected to the wax pattern 12, to connect to the base plate 22. In this manner, the support capping structure 32 and the plurality of support braces 38 can secure the wax pattern 12 to the base plate 22 in a fixed position. This allows the load of the wax pattern 12 to be uniformly distributed while secured to the base plate.

In one embodiment, the support braces 38 can include struts, rods, legs and the like. The support braces 38 can include off-the-shelf components or they can be printed with a ceramic or metal material using any of the aforementioned additive manufacturing processes. Also, the support braces 38 can be cast themselves. Regardless of whether the support braces 38 are printed using an additive manufacturing process, cast, or obtained as off-the-shelf components, the braces are used to hold the wax pattern 12 and the support capping structure 32 placed thereon in a fixed position with respect to the base plate 22 and the tree that contains the wax pattern and any other patterns.

In one embodiment, the support capping structure 32 can include brackets 40 to receive each of the support braces 38. The brackets 40 can be formed on the support capping structure 32 as part of the additive manufacturing process used to print the support capping structure. In this manner, one end of the support braces 38 can be received and secured within the brackets 40, while the other end of the braces can be received and secured to the base plate 22. It is understood that the brackets 40 represent one mechanism for receiving and securing the braces 38 and are not meant to be limiting.

Figure 3:
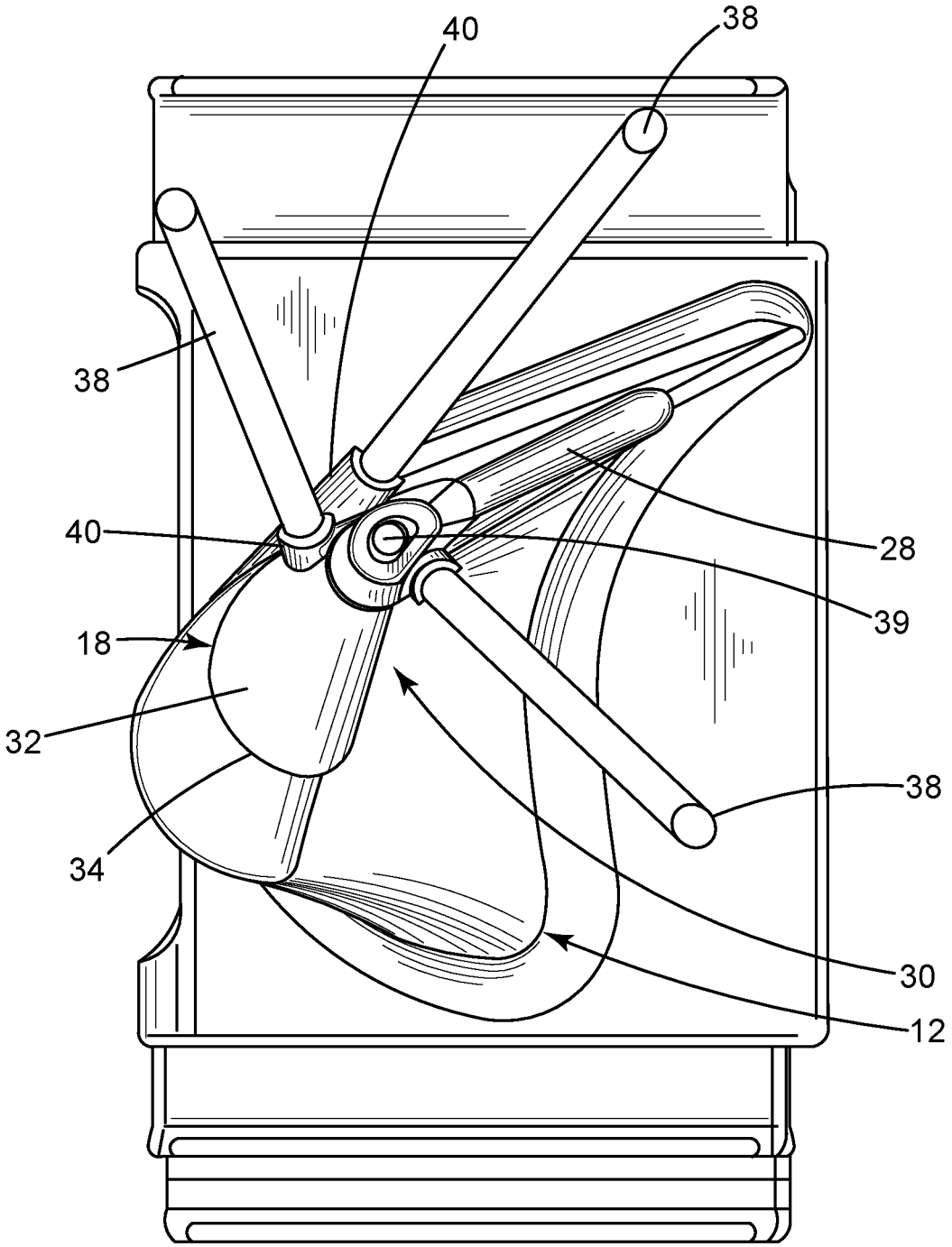
FIG. 3 shows a schematic of a bottom plan view of a support structure for supporting a wax pattern of a part that is to be cast in an investment casting process according to an embodiment of the invention.
Figure 4:
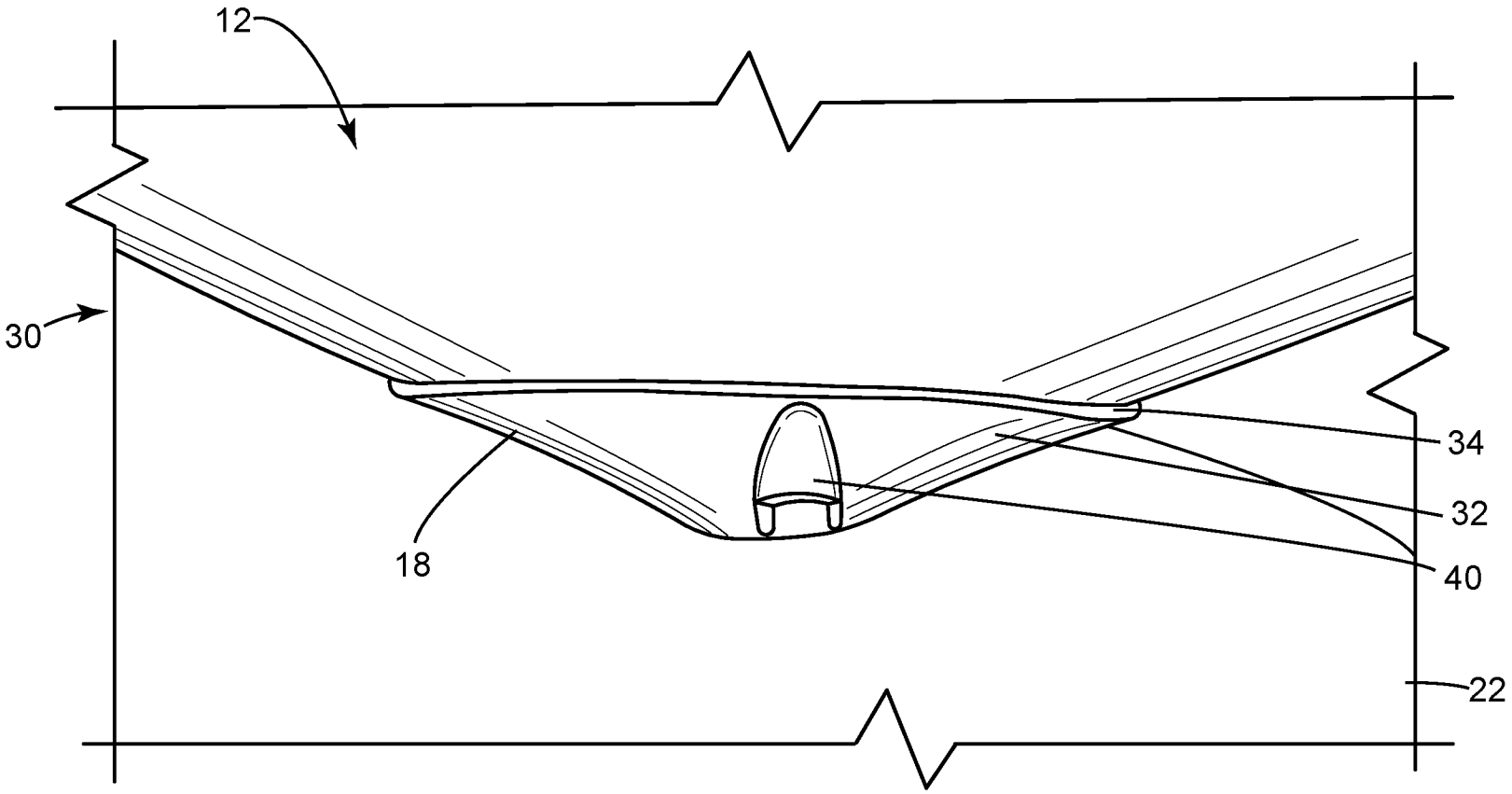
FIG. 4 shows a schematic of a more detailed view of a support capping structure of the support structure depicted in FIG. 2 according to an embodiment of the invention.

FIGS. 2, 3 and 5 shows that the support braces 38 can be positioned about the support capping structure 32 and the base plate 22 in a manner that enhances the capability of the support structure 30 to uniformly distribute the load of the wax pattern 12 while secured to the base plate 22. In one embodiment, each of the support braces 38 can be angled to the support capping structure 32 and the base plate 22. For example, each of the support braces 38 can be spaced apart from one another at the support capping structure 32 and the base plate 22 in a tripod configuration (e.g., 3 support braces) to provide support from a multiple of different directions. This allows the support braces 38 to be angled to the base plate 22 from a single location while still staying within the defined allowed envelope 36 of the wax pattern 12 at the other end.

In one embodiment, the spacing between each of the support braces 38 at the base plate 22 can be greater than the spacing of each of the support braces at the support capping structure 32. With this configuration, the support capping structure 32 can support a greater portion of the load of the wax pattern 12 than a portion of the load supported by the support braces 38.

FIG. 6 shows a flow chart 46 illustrating the operations associated with the investment casting of a part from a wax pattern that can be supported by the support structure 30 depicted in FIGS. 2-5. In the flow chart of FIG. 6, the first step is to obtain a wax pattern of a part at 48. The wax pattern will have the same details as the finished the part. For example, the wax pattern of a turbine part can have the same shape except that there is an allowance for thermal contraction. In one embodiment, the wax pattern can be made with the use of a metal injection die.

The support structure used to support the wax pattern can be generated at 50. In one embodiment, the support structure can be printed with an additive manufacturing process. As described herein, the printed support structure can have a support capping structure with a geometry that matches a profile of a lower region of the wax pattern, and support braces that extend outward from the support capping structure.

The support structure can be placed about a surface of the wax pattern at 52. In one embodiment, the support structure can be placed on a bottom surface of the wax pattern. In another embodiment, the support structure can be placed on the lower region of the wax pattern. As mentioned above, the support structure can be preferably shaped in a manner that matches the lower region of the wax pattern, and positioned such that the load of the pattern can be evenly distributed against the lower region of the pattern. In one embodiment, the support capping structure forms a defined envelope around the bottom surface of the wax pattern that extends upward to enclose the lower region of the wax pattern after placement thereon. In another embodiment, the support capping structure forms a defined envelope to enclose the lower region of the wax pattern upon placement thereon.

Next, the support structure is connected to the base plate at 54. In one embodiment, the support braces can connect to the base plate at one end and to the support capping structure at another end. In this manner, the support capping structure and the support braces can secure the wax pattern to the base plate and uniformly distribute the load of the wax pattern while secured to the base plate.

With this assembly, the tree with the wax patterns and respective support structures affixed thereto can undergo a shelling process at 56. In particular, a mold shell is created that surrounds the wax patterns and the support structure while the wax patterns are secured to the base plate. As noted previously, this can include turning the tree of wax patterns upside down and dipping them in a ceramic slurry and then coating with refractory sand. The dipping and coating is repeated until a shell with multiple layers is formed to have the desired thickness. The thickness can be dictated by the part size and configuration. Once the ceramic shell has dried, it is able to retain the molten metal during casting.

Each wax pattern and the support structure can be removed from the mold shell at 58. In one embodiment, the entire assembly of wax patterns and respective support structures can be placed in a steam autoclave to melt away most of the wax. Any remaining wax soaked into the ceramic shell can be burned out in a furnace. At this point, the ceramic mold remains with a cavity in the shape of the desired cast part.

The ceramic mold shell can then be filled with a molten metal to cast the part at 60. In one embodiment, the ceramic mold shell can be heated to a specific temperature and filled with molten metal, creating the metal casting.

Once the casting has cooled sufficiently, the ceramic mold shed can be broken away from the casting in a knockout operation at 62. In one embodiment, the runner can be cut from the casting. If necessary, final post-processing operations that can include, but are not limited to, sandblasting, grinding, and machining can be performed to finish the casting dimensionally.

While, for purposes of simplicity of explanation, the operations shown in FIG. 6 are described as a series of acts. It is to be understood and appreciated that the subject innovation associated with FIG. 6 is not limited by the order of acts, as some acts may, in accordance therewith, occur in a different order and/or concurrently with other acts from that shown and described herein. For example, those skilled in the art will understand and appreciate that a methodology or operations depicted in FIG. 6 could alternatively be represented as a series of interrelated states or events, such as in a state diagram. Moreover, not all illustrated acts may be required to implement a methodology in accordance with the innovation. Furthermore, interaction diagram(s) may represent methodologies, or methods, in accordance with the subject disclosure when disparate entities enact disparate portions of the methodologies. Further yet, two or more of the disclosed example methods can be implemented in combination with each other, to accomplish one or more features or advantages described herein. Accordingly, it should be apparent that the support structure described herein, as well as the method steps used to create the support structure, and implement such structure in an investment casting process, are amenable for industrial application in that it relates to the technical field of casting parts and components of a variety of shapes, and present a solution to a technical problem of breakage of a wax pattern during the shelling process of the pattern. The use of the support structure described herein can provide a more robust connection with the wax pattern and base plate that minimizes the likelihood that breakage will occur during the shelling process of investment casting in which the wax pattern undergoes dipping in a ceramic slurry and coating with refractory sand to form a ceramic shell that encloses the wax pattern.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize. For example, parts, components, steps and aspects from different embodiments may be combined or suitable for use in other embodiments even though not described in the disclosure or depicted in the figures. Therefore, since certain changes may be made in the above-described invention, without departing from the spirit and scope of the invention herein involved, it is intended that all of the subject matter of the above description shown in the accompanying drawings shall be interpreted merely as examples illustrating the inventive concept herein and shall not be construed as limiting the invention.

In this regard, while the disclosed subject matter has been described in connection with various embodiments and corresponding figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below. For example, references to "one embodiment" of the present invention are not intended to be interpreted as excluding the existence of additional embodiments that also incorporate the recited features.

In the appended claims, the terms "including" and "in which" may be used as the plain-English equivalents of the respective terms "comprising" and "wherein." Moreover, in the following claims, terms such as "first," "second," "third," "upper," "lower," "bottom," "top," etc. are merely labels, and are not intended to impose numerical or positional requirements on their objects. The terms "substantially," "generally," and "about" indicate conditions within reasonably achievable manufacturing and assembly tolerances, relative to ideal desired conditions suitable for achieving the functional purpose of a component or assembly. Further, the limitations of the following claims are not written in means-plus-function format and are not intended to be interpreted as such, unless and until such claim limitations expressly use the phrase "means for" followed by a statement of function void of further structure.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form.

What has been described above includes examples of systems and methods illustrative of the disclosed subject matter. It is, of course, not possible to describe every combination of components or methodologies here. One of ordinary skill in the art may recognize that many further combinations and permutations of the claimed subject matter are possible. Furthermore, to the extent that the terms "includes," "has," "possesses," and the like are used in the detailed description, claims, appendices and drawings, such terms are intended to be inclusive in a manner similar to the term "comprising" as "comprising" is interpreted when employed as a transitional word in a claim. That is, unless explicitly stated to the contrary, embodiments "comprising," "including," or "having" an element or a plurality of elements having a particular property may include additional such elements not having that property.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

Further aspects of the invention are provided by the subject matter of the following clauses:

An apparatus to support a wax pattern of a part that is to be cast to a base plate during an investment casting process of the part, the apparatus comprising: a support structure placed about the wax pattern, wherein the support structure matches a shape of a surface of the wax pattern; and at least one support brace extending outward from the support structure to connect to the base plate, wherein the support structure and the at least one support brace secure the wax pattern to the base plate in a fixed position and distribute the load of the wax pattern while secured to the base plate.

The apparatus of the preceding clause, wherein the at least one support brace comprises a plurality of support braces, wherein each of the support braces are angled to the support structure and the base plate.

The apparatus of any of the preceding clauses, wherein each of the plurality of support braces are spaced apart from one another at the support structure and the base plate.

The apparatus of any of the preceding clauses, wherein the spacing between each of the support braces at the base plate is greater than the spacing of each of the support braces at the support structure.

The apparatus of any of the preceding clauses, wherein the support structure supports a greater portion of the load of the wax pattern than a portion of the load supported by the at least one support brace.

The apparatus of any of the preceding clauses, wherein the force of the load of the wax pattern received by the support structure is distributed evenly against the bottom surface of the wax pattern.

The apparatus of any of the preceding clauses, wherein the support structure forms a defined envelope around the surface of the wax pattern after placement thereon, and wherein the defined envelope is formed around a bottom surface of the wax pattern and extends upward to enclose a lower region of the wax pattern.

The apparatus of any of the preceding clauses, wherein the support structure comprises a geometry that matches a profile of the lower region of the wax pattern.

The apparatus of any of the preceding clauses, wherein the wax pattern comprises a gas turbine part.

A method for supporting a wax pattern of a part during an investment casting process of the part, the method comprising: forming a support structure to support the wax pattern during the investment casting of the part, wherein the support structure comprises a support capping structure with a geometry that matches a profile of a lower region of the wax pattern, and a plurality of support braces extending outward from the support capping structure; placing the support structure on a surface of the lower region of the wax pattern, wherein the support capping structure forms a defined envelope around the lower region of the wax pattern after placement thereon; and connecting the support structure to a base plate, wherein the plurality of support braces connect to the base plate, wherein the support capping structure and the plurality of support braces secure the wax pattern to the base plate in a fixed position and uniformly distribute the load of the wax pattern while secured to the base plate.

The method of the preceding clause, wherein the connecting of the plurality of support braces to the base plate comprises angling each of the plurality of support braces to the support capping structure and the base plate.

The method of any of the preceding clauses, wherein the connecting of the plurality of support braces to the base plate comprises spacing each of the plurality of support braces apart from one another at the support capping structure and the base plate.

The method of any of the preceding clauses, wherein the spacing between each of the support braces at the base plate is greater than the spacing at each of the support braces at the support capping structure The method of any of the preceding clauses, wherein the support capping structure supports a greater portion of the load of the wax pattern than a portion of the load supported by the plurality of support braces.

The method of any of the preceding clauses, wherein the force of the load of the wax pattern received by the support capping structure is distributed evenly against the lower region of the wax pattern.

The method of any of the preceding clauses, wherein the forming of the support structure comprises printing the support structure using an additive manufacturing process.

A method, comprising: obtaining a wax pattern of a part; printing a support structure to support the wax pattern with an additive manufacturing process, wherein the support structure comprises a support capping structure with a geometry that matches a profile of a lower region of the wax pattern, and a plurality of support braces extending outward from the support capping structure; placing the support structure on a surface of the lower region of the wax pattern, wherein the support capping structure forms a defined envelope to enclose the lower region of the wax pattern after placement thereon; connecting the support structure to a base plate, wherein the plurality of support braces connect to the base plate, wherein the capping structure and the plurality of support braces secure the wax pattern to the base plate and uniformly distribute the load of the wax pattern while secured to the base plate; and creating a mold shell that surrounds the wax pattern and the support structure while the wax pattern is secured to the base plate.

The method of the preceding clause, further comprising removing the wax pattern and the support structure from the mold shell.

The method of any of the preceding clauses, further comprising filling the mold shell with a molten metal to cast the part.

The method of any of the preceding clauses, further comprising breaking the mold shell away from the casted part.

What is claimed is:

1. A method for supporting a wax pattern of a part during an investment casting process of the part, the method comprising:

forming a support structure to support the wax pattern during the investment casting of the part, wherein the support structure comprises a support capping structure with a geometry that matches a profile of a lower region of the wax pattern, and a plurality of support braces extending outward from the support capping structure;

placing the support structure on a surface of the lower region of the wax pattern, wherein the support capping structure forms a defined envelope around the lower region of the wax pattern after placement thereon; and connecting the support structure to a base plate, wherein the plurality of support braces connect to the base plate, wherein the support capping structure and the plurality of support braces secure the wax pattern to the base plate in a fixed position and uniformly distribute the load of the wax pattern while secured to the base plate.

2. The method according to claim 1, wherein the connecting of the plurality of support braces to the base plate comprises angling each of the plurality of support braces to the support capping structure and the base plate.

3. The method according to claim 1, wherein the connecting of the plurality of support braces to the base plate comprises spacing each of the plurality of support braces apart from one another at the support capping structure and the base plate.

4. The method according to claim 1, wherein the spacing between each of the support braces at the base plate is greater than the spacing at each of the support braces at the support capping structure.

5. The method according to claim 1, wherein the support capping structure supports a greater portion of the load of the wax pattern than a portion of the load supported by the plurality of support braces.

6. The method according to claim 1, wherein a force of a load of the wax pattern received by the support capping structure is distributed evenly against the lower region of the wax pattern.

7. The method according to claim 1, wherein the forming of the support structure comprises printing the support structure using an additive manufacturing process.

8. A method, comprising:

obtaining a wax pattern of a part;

printing a support structure to support the wax pattern with an additive manufacturing process, wherein the support structure comprises a support capping structure with a geometry that matches a profile of a lower region of the wax pattern, and a plurality of support braces extending outward from the support capping structure;

placing the support structure on a surface of the lower region of the wax pattern, wherein the support capping structure forms a defined envelope to enclose the lower region of the wax pattern after placement thereon;

connecting the support structure to a base plate, wherein the plurality of support braces connect to the base plate, wherein the capping structure and the plurality of support braces secure the wax pattern to the base plate and uniformly distribute the load of the wax pattern while secured to the base plate; and creating a mold shell that surrounds the wax pattern and the support structure while the wax pattern is secured to the base plate.

9. The method according to claim 8, further comprising removing the wax pattern and the support structure from the mold shell.

10. The method according to claim 9, further comprising filling the mold shell with a molten metal to cast the part.

11. The method according to claim 10, further comprising breaking the mold shell away from the casted part.

* * * * *